US005898145A

United States Patent [19]

Su

[11] Patent Number: 5,898,145

[45] Date of Patent: Apr. 27, 1999

[54] COMPUTER KEY

[75] Inventor: Tsui-Jong Su, Taipei Hsien, Taiwan

[73] Assignee: Shin Jiuh Corp., Taipei Hsien, Taiwan

[21] Appl. No.: 09/003,366

[22] Filed: Jan. 6, 1998

Related U.S. Application Data

[63] Continuation-in-part of application No. 08/919,104, Aug. 28, 1997, abandoned.

[30] Foreign Application Priority Data

May 7, 1997 [TW] Taiwan ..... 86207350
Nov. 4, 1997 [TW] Taiwan ..... 86218513

[51] Int. Cl.[6] ..... H01H 13/70

[52] U.S. Cl. ..... 200/344; 200/341

[58] Field of Search ..... 200/344, 341, 200/345, 512, 513, 514, 515, 516, 517, 520

[56] References Cited

U.S. PATENT DOCUMENTS 5,630,501 5/1997 Tsay ..... 200/344
5,657,860 8/1997 Koike et al. ..... 200/344
5,695,047 12/1997 Tanahashi ..... 200/344
5,746,308 5/1998 Lin ..... 200/344
5,770,824 6/1998 Tsai et al. ..... 200/344

*Primary Examiner*—David J. Walczak
*Attorney, Agent, or Firm*—Finnegan, Henderson, Farabow, Garrett & Dunner, L.L.P.

[57] ABSTRACT

A computer key includes a base plate, a membrane circuit, a foil sheet, a biasing member, a push button, and first and second linking frames. The base plate includes a first hingeably retaining member and a first slidably retaining guideway spaced from each other in a longitudinal direction and formed with first and second retaining portions for blocking movement in an upward and normal direction. The membrane circuit is disposed on the base plate, and has left and right openings for extension of the first and second retaining portions therethrough. The foil sheet is superimposed on the membrane circuit to sandwich a lower flange on the biasing member therebetween. The first and second linking frames have first and second linking arms connected pivotally at intermediate portions to permit extension of the biasing member such that the latter is disposed between the push button and the base plate. The first linking arms have a lower portion with front and rear hooking ends, wherein the front hooking end can be inserted from a parallel direction relative to a plane of the base plate for retaining the front and rear hooking ends in the first hingeably retaining member of the base plate to block movement in the upward and normal direction.

7 Claims, 6 Drawing Sheets

COMPUTER KEY

CROSS-REFERENCE OF RELATED APPLICATION

This invention is a Continuation-in-Part of co-opening U.S. Pat. application Ser. No. 08/919,104, entitled "Computer Key" which was filed on Aug. 28, 1997, now abandon.

BACKGROUND OF THE INVENTION

1. Field of the Invention

The invention relates to a computer key, more particularly to a computer key which includes a biasing member mounted between a base member and a push button such that the biasing member will not disengage from the base member regardless of the position of the applied force. The base member is of a unique structure such that the overall height of the computer key is reduced as compared to that of the conventional computer key.

2. Description of the Related Art

Referring to FIGS. 1 and 2, a known computer key is shown to include a base board consisting of a lower base plate 16 and a membrane circuit 15, an upper base plate 12, an upright elastomeric biasing member 14, first and second linking frames 131, 132, and a push button 11.

As illustrated, the membrane circuit 15 is disposed above the lower base plate 16. The upper base plate 12 is disposed above the membrane circuit 15 and includes a hole defining portion 12A with an inner peripheral portion 12B that defines a retaining hole 21 therethrough to expose a contact area 150 of the membrane circuit 15, a first hingeably retaining groove 122, and a first slidably retaining guideway 123 disposed on an opposite side of the retaining hole 21 relative to the first hingeably retaining groove 122. The inner peripheral portion 12B has an upper annular wall 22 with a first inner diameter, and a lower annular wall 23 with a second inner diameter which is greater than the first inner diameter to form an annular shoulder 24 between the upper and lower annular walls 22, 23.

The biasing member 14 includes an upper depressing portion 142, and a spacing lower portion 141 to space the upper depressing portion 142 from the contact area 150. The lower portion 141 of the biasing member 14 has a flange portion 32 which extends outwardly from a lower end thereof and which is inserted into an annular groove defined by the shoulder 24 and the membrane circuit 15. The depressing portion 141 of the biasing member 14 is movable against the biasing action thereof and through the retaining hole 21 to depress the contact area 150 of the membrane circuit 15 for generation of an electrical signal.

The push button 11 is disposed to actuate the the biasing member 14, and has a second hingeably retaining groove 112 and a second slidably retaining guideway 113 which are disposed underside thereof in diagonal positions relative to the first slidably retaining guideway 123 and the first hingeably retaining groove 122, respectively.

The first linking frame 131 includes a first transverse axle 1311 press-fitted to and retained hingeably in the first hingeably retaining groove 122 of the upper base plate 12, and a pair of first linking arms 1312 which extend respectively and radially from two ends of the first transverse axle 1311 and which have a pair of first hooking fingers 1313 at distal ends thereof and parallel to the first transverse axle 1311. The first hooking fingers 1313 are fitted to and slidably retained in the second slidably retaining guideway 113 of the push button 11.

The second linking frame 132 includes a second transverse axle 1321 press-fitted to and hingeably retained in the second hingeably retaining groove 112 of the push button 11, and a pair of second linking arms 1322 which extend respectively and radially from two ends of the second transverse axle 1321 to flank the first linking arms 1312 and which have a pair of second hooking fingers 1323 at distal ends thereof parallel to the second transverse axle 1321. The second hooking fingers 1323 are fitted to and retained slidably in the first slidably retaining guideway 123 of the upper base plate 12. The first and second linking arms 1312, 1322 are connected pivotally at intermediate portions thereof to confine a column of space for accommodating the depressing movement of the biasing member 14 when the first transverse axle 1311, the first hooking fingers 1313, the second transverse axle 1321, and the second hooking fingers 1323 are received in the first hingeably retaining groove 122, the second slidably retaining guideway 113, the second hingeably retaining groove 112 and the first slidably retaining guideway 123, respectively.

A drawback of the aforesaid computer key resides in that the upper base plate 12 must have a relative thickness in order to form the annular shoulder 24 between the upper and lower walls 22, 23. As a result, overall height reduction thereof is still not satisfactory.

SUMMARY OF THE INVENTION

The object of this invention is to provide a computer key which includes a base plate of a unique structure such that, after assembly, the overall height of the computer key is considerably reduced.

Accordingly, a computer key of this invention includes a base plate, a membrane circuit, a foil sheet member, an upright biasing member, a push button, and a frame unit consisting of first and second linking frames. The base plate includes a first hingeably retaining member and a first slidably retaining guideway which is disposed apart from the first hingeably retaining member in a longitudinal direction of the base plate to define an actuation area therebetween. The first hingeably retaining member and the first slidably retaining guideway have first and second retaining portions which extend uprightly from an upper surface of the base plate to block movement in an upward and normal direction relative to a plane of the upper surface of the base plate. The membrane circuit is disposed on the base plate, and has a contact area of a first dimension superimposed upon the actuation area, and first left and right openings which are disposed to correspond with positions of the first and second retaining portions to permit the first and second retaining portions to extend outwardly through the first left and right openings of the membrane circuit. The foil sheet member is superimposed on the membrane circuit, and has a through hole of a second dimension corresponding to the contact area so as to expose the same, and second left and right openings which are disposed aligned with the first left and right openings so as to permit the first and second retaining portions to extend outwardly through the second left and right openings. The biasing member includes an upper depressing portion and a spacing lower portion to space the upper depressing portion from the contact area. The lower portion of the biasing member has a flange portion that extends outwardly from a lower end thereof with a third dimension such that when the biasing member is seated above the contact area. As such, the flange portion can be sandwiched between the membrane circuit and the foil sheet member. The upper depressing portion of the biasing member is movable against a biasing action thereof via the through hole of the foil sheet member to depress the contact area of the membrane circuit to generate an electrical signal. The push button is disposed to actuate the biasing member, and has a second hingeably retaining groove and a second slidably retaining guideway in an underside thereof in diagonal positions relative to the first slidably retaining guideway and the first hingeably retaining member, respectively.

The first linking frame includes a first transverse arm which has a rear hooking end, a front hooking end and a first transverse axle interposed therebetween, and a pair of first linking arms. The front hooking end is inserted from a parallel direction relative to the plane of the upper surface of the base plate to hingeably retain the front and rear hooking ends in the first hingeably retaining member of the base plate so as to be blocked by the first retaining portion from movement in the upward and normal direction. The first linking arms extend respectively and radially from two ends of the first transverse axle inboard to the front and rear hooking ends, respectively. The first linking arms have a pair of first hooking fingers at distal ends thereof which are parallel to the first transverse axle. The first hooking fingers are fitted to and are slidably retained in the second slidably retaining guideway of the push button.

The second linking frame includes a second transverse axle retained hingeably in the second hingeably retaining groove of the push button, and a pair of second linking arms. The second linking arms respectively and radially extend from two ends of the second transverse axle, and have a pair of second hooking fingers at distal ends thereof which are parallel to the second transverse axle. The second hooking fingers are fitted to for slidable retention in the first slidably retaining guideway of the base plate.

The first and second linking arms are connected pivotally to each other at intermediate portions thereof such that the first and second linking arms confine a column of space for accommodating depressing movement of the biasing member when the front and rear hooking ends, the first hooking fingers, the second transverse axle, and the second hooking fingers are received in the first hingeably retaining member, the second slidably retaining guideway, the second hingeably retaining groove and the first slidably retaining guideway, respectively.

The overall height of the computer key of this invention is reduced due to employment of only the base plate, whereas the aforementioned conventional computer key includes a base board consisting of upper and lower base plates.

BRIEF DESCRIPTION OF THE DRAWINGS

Other features and advantages of this invention will become more apparent in the following preferred embodiment with reference to the accompanying drawings, in which.

DETAILED DESCRIPTION OF THE PREFERRED EMBODIMENT

Figure 1:
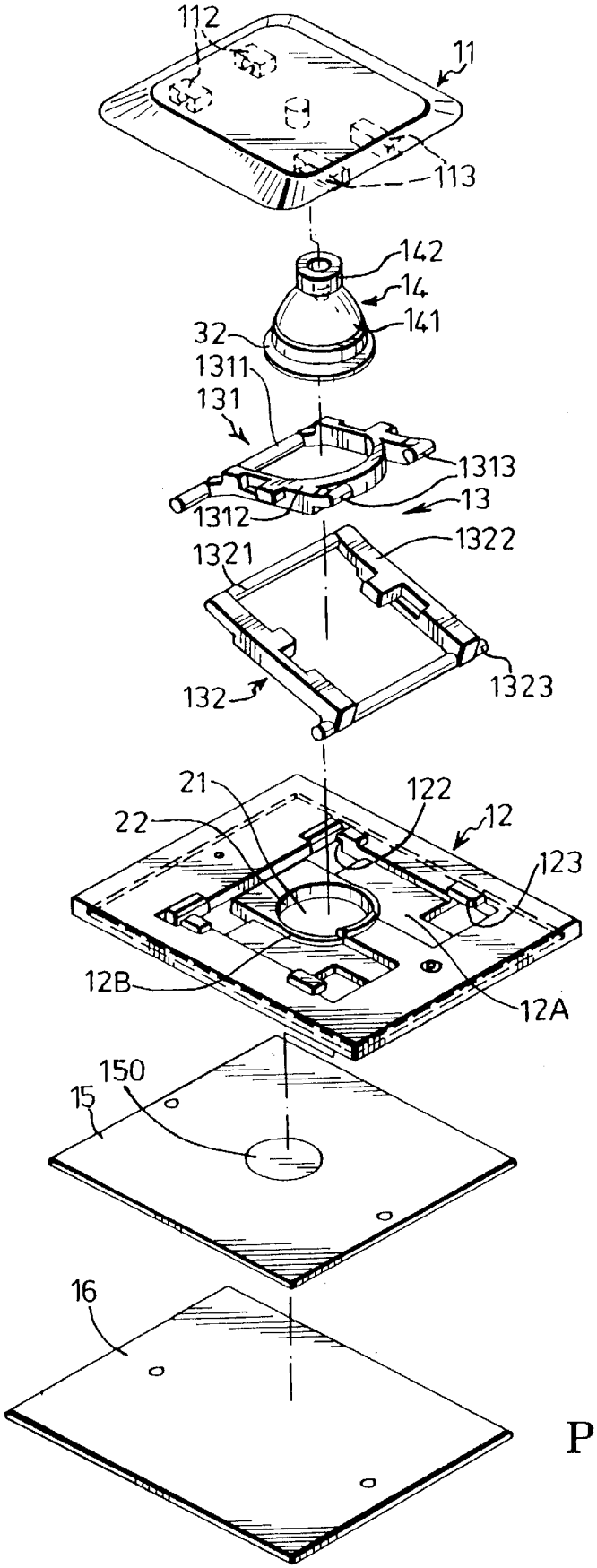
PRIOR ART FIG. 1
FIG. 1 is an exploded view of a conventional computer key.
Figure 2:
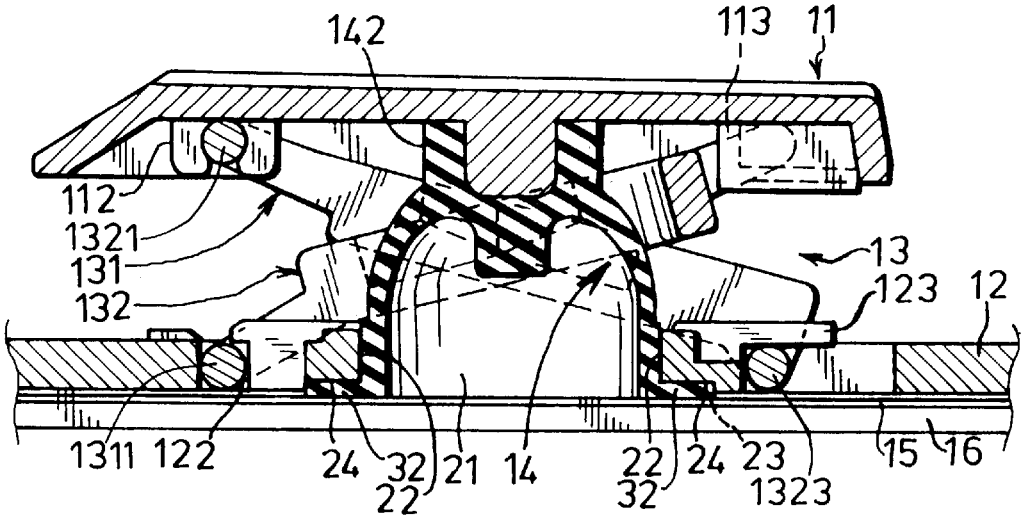
FIG.2 PRIOR ART
FIG. 2 is a sectional view of the conventional computer key, illustrating assembly of the components thereof.
Figure 3:
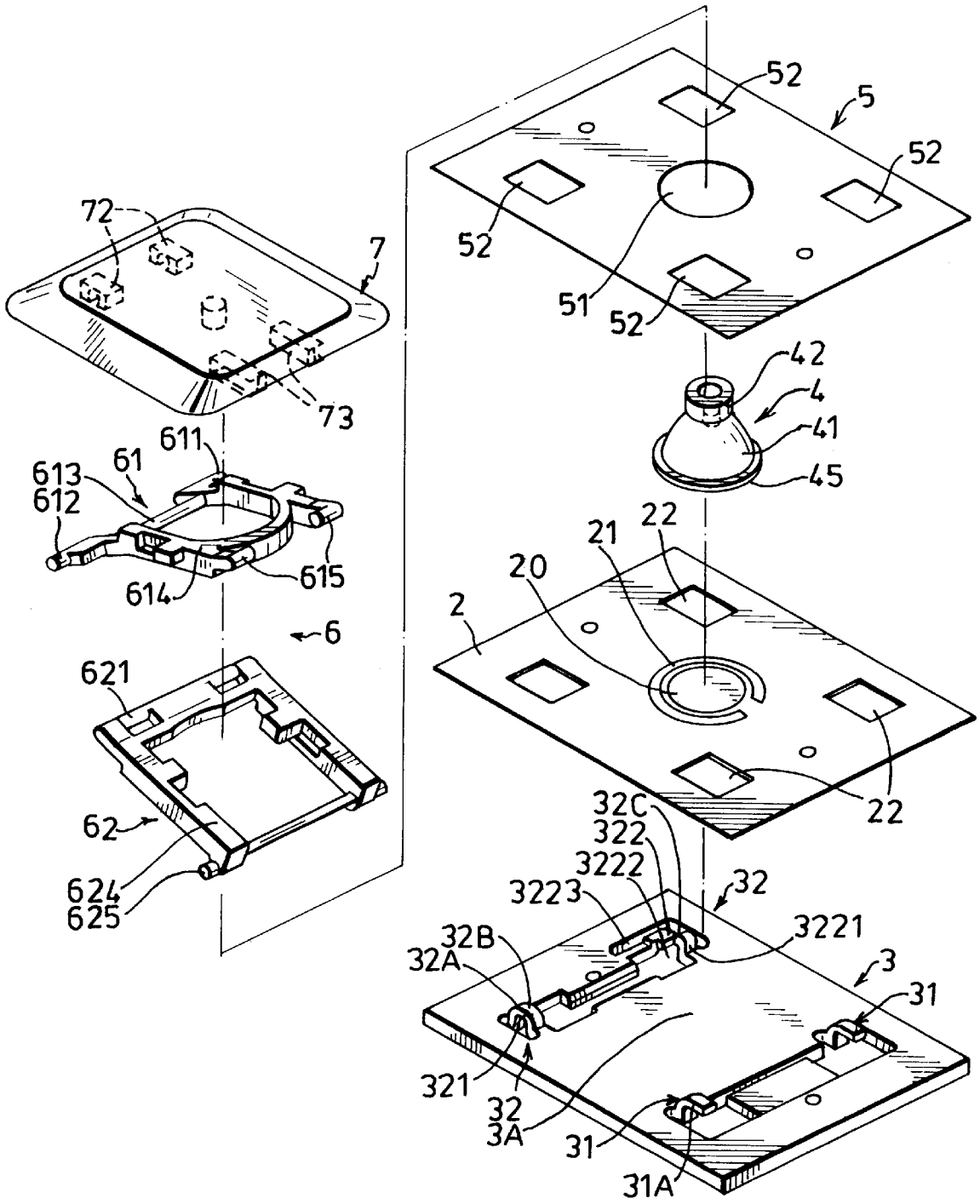
FIG. 3 is an exploded view of a preferred embodiment of a computer key according to this invention.
Figure 4:
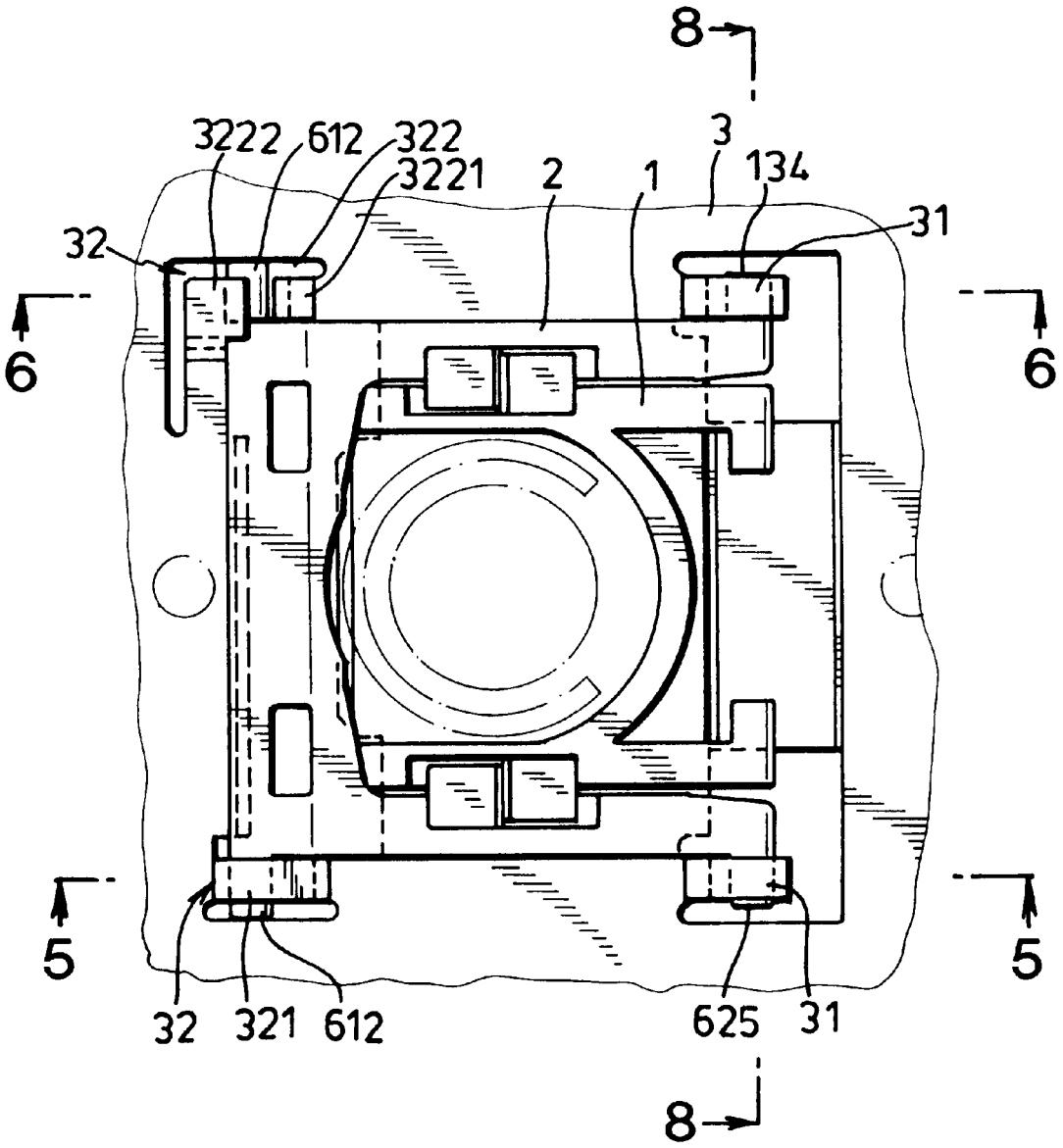
FIG. 4 is a top view of the preferred embodiment, illustrating the preferred embodiment in an assembled state.
Figure 5:
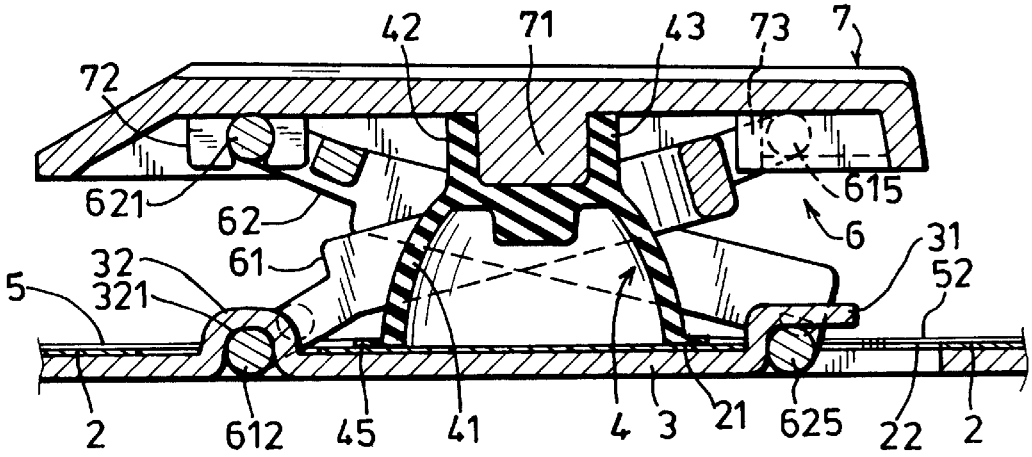
FIG. 5 is a sectional view of the preferred embodiment taken along the line 5—5 in FIG. 4.
Figure 6:
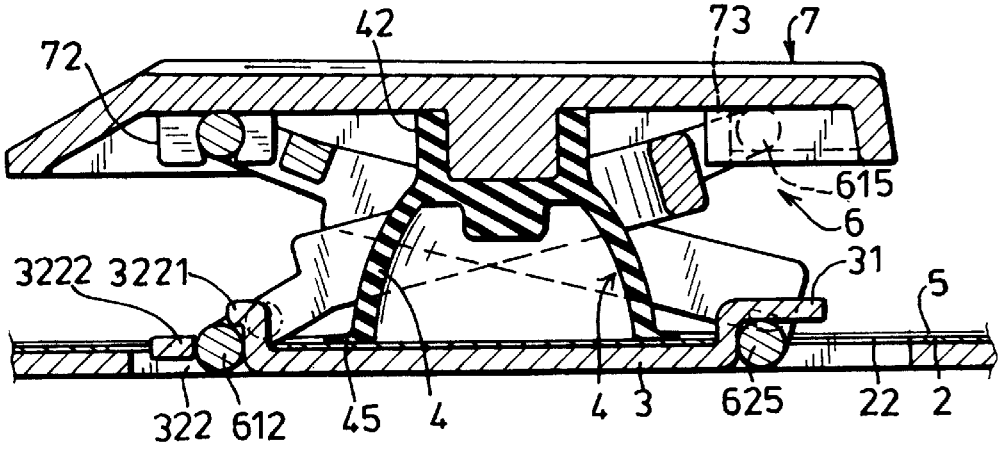
FIG. 6 is a sectional view of the preferred embodiment, taken along the line 6—6 in FIG. 4.

Referring to FIGS. 3, 4 and 5, a preferred embodiment of a computer key according to this invention is shown to include a base plate 3, a membrane circuit 2, a foil sheet member 5, an upright elastomeric biasing member 4, a push button 7, and a frame member 6 consisting of a first linking frame 61 and a second linking frame 62.

As illustrated, the base plate 3 includes a first hingeably retaining member 32 and a first slidably retaining guideway 31 which are disposed to be spaced apart from each other in a longitudinal direction of the base plate 3 to define an actuation area 3A therebetween. The first hingeably retaining member 32 and the first slidably retaining guideway 31 have first and second retaining portions 32A, 31A which extend uprightly from an upper surface of the base plate 3 to block movement in an upward and normal direction relative to a plane of the upper surface of the base plate 3.

The membrane circuit 2 is disposed on the base plate 3, and has a contact area 20 superimposed upon the actuation area 3A, and first left and right openings 22 which are disposed to corresponding positions of the first and second retaining portions 32A, 31A to permit extension of the latter therethrough.

The foil sheet member 5 is superimposed on the membrane circuit 2, and has a through hole 51 of a dimension corresponding to the dimension of the contact area 20 to expose the same, and second left and right openings 52 aligned with the first left and right openings 22 so that the first and second retaining portions 32A can extend outwardly through the second left and right openings 52.

The biasing member 4 includes an upper depressing portion 42, and a spacing lower portion 41 to space the upper depressing portion 42 from the contact area 20. The lower portion 41 of the biasing member 4 has a flange portion 45 that extends outwardly from a lower end thereof with a dimension such that, when the biasing member 4 is seated above the contact area 20, the flange portion 45 is sandwiched between the membrane circuit 2 and the foil sheet member 5. The upper depressing portion 42 of the biasing member 4 is movable against a biasing action thereof via the through hole 51 of the foil sheet member 5 to depress the contact area 20 of the membrane circuit 2 to generate an electrical signal.

The push button 7 is disposed to actuate the biasing member 4, and hats a second hingeably retaining groove 72 and a second slidably retaining guideway 73 at an underside thereof in diagonal positions relative to the first slidably retaining guideway 31 and the first hingeably retaining member 32, respectively.

The first linking frame 61 includes a first transverse arm having a rear hooking end 611, a front hooking end 612 and a first transverse axle 613 interposed therebetween, and a pair of first linking arms 614. The first linking arms 614 respectively and radially extend from two ends of the first transverse axle 613 inboard to the front and rear hooking ends 612, 611, respectively. The front hooking end 612 is inserted from a parallel direction relative to the plane of the upper surface of the base plate 3 to hingeably retain the front and rear hooking ends 612, 611 in the first hingeably retaining member 32 of the base plate 3 so as to be blocked by the first retaining portion 32A from movement in the upward and normal direction. The first linking arms 614 have a pair of first hooking fingers 615 at distal ends thereof which are parallel to the first transverse axle 611. The first hooking fingers 615 are fitted to and retained slidably in the second slidably retaining guideway 73 of the push button 7.

The second linking frame 62 includes a second transverse axle 621 hingeably retained in the second hingeably retaining groove 72 of the push button 7, and a pair of second linking arms 624. The second linking arms 624 respectively and radially extend from two ends of the second transverse axle 621, and have a pair of second hooking fingers 625 at distal ends thereof which are parallel to the second transverse axle 621. The second hooking fingers 625 are fitted for slidable retention in the first slidably retaining guideway 31 of the base plate 3.

The first and second linking arms 614, 624 are connected pivotally to each other at intermediate portions thereof such that the first and second linking arms 614, 624 confine a column of space for accommodating depressing movement of the biasing member 4 when the front and rear hooking ends 612, 611, the first hooking fingers 615, the second transverse axle 621, and the second hooking fingers 625 are received in the first hingeably retaining member 32, the second slidably retaining guideway 73, the second hingeably retaining groove 72 and the first slidably retaining guideway 31, respectively.

In the preferred embodiment, the base plate 3, the first hingeably retaining member 32 and the first slidably retaining guideway 31 are formed by punching a one-piece metal plate to form the first and second retaining portions 32A, 31A on an opposite side of the punching direction. The first retaining portion 32A includes a front retaining member 32B and a rear retaining member 32C disposed to be spaced apart from each other in a transverse direction relative to the longitudinal length of the base plate 3 to retain the front and rear hooking ends 612, 611, respectively. The front retaining member 32B is of an arched shape and has a blocking upper segment 321 which extends in a parallel direction relative to the plane of the upper surface of the base plate 3 to block the front hooking end 612 from movement in the upward and normal direction. The rear retaining member 32C includes left and right jaw portions 3222, 3221 which are disposed uprightly and which are spaced from each other in the longitudinal direction of the base plate 3. The left and right jaw portions 3222, 3221 define a clearance 322 which is slightly smaller than the dimension of the cross section of the rear hooking end 611 for press-fitting of the latter when the rear hooking end 611 is retained hingeably between the left and right jaw portions 3222, 3221.

Figure 7:
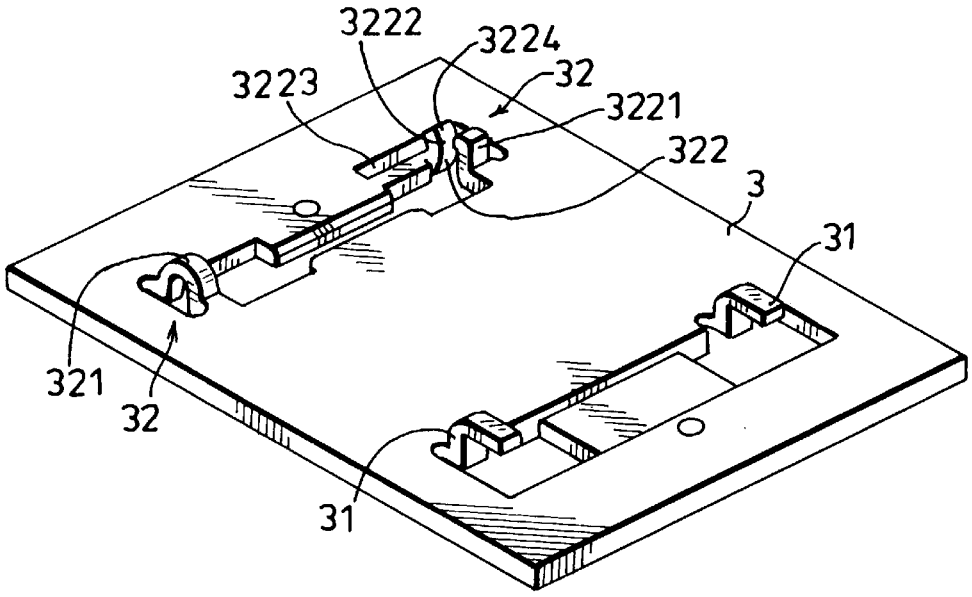
FIG. 7 is a perspective view of a base plate employed in the preferred embodiment.
Figure 8:
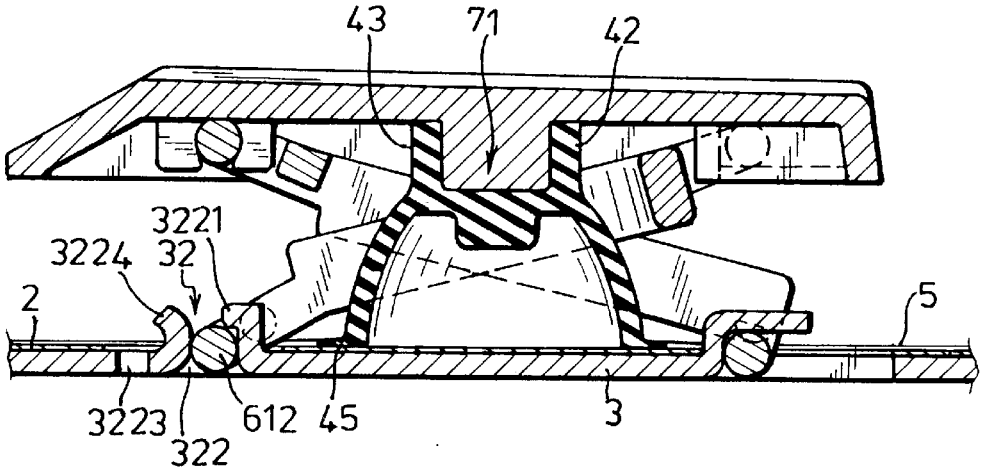
FIG. 8 is a sectional view of the preferred embodiment, taken along the line 8—8 in FIG. 4.

Referring to FIGS. 7 and 8, the upper end portion 3224 of the left jaw portion 3222 is bent in the longitudinal direction of the base plate 3 away from the right jaw portion 3221 in such a manner that the right jaw portion 3221 stands taller than the left jaw portion 3222, thereby forming a guideway to facilitate press-fitting of the rear hooking end 611 into the clearance 322. The base plate 3 further defines a transverse slit 3223 adjacent to the left jaw portion 3222 at a side opposite to the clearance 322 for providing additional resiliency to the left jaw portion 3222 in the longitudinal direction of the base plate 3.

The preferred embodiment further includes an adhesive layer 21 (see FIG. 3) interposed between the flange portion 45 and the foil sheet member 52 to further strengthen immobility of the flange portion 45 relative to the base plate 3. The upper depressing portion 42 is formed with an engagement hole 43 (see FIG. 5) which is press-fitted by the downwardly extending stud 71 of the push button 7. Since the flange portion 45 is adhesively attached to the peripheral portion of the contact area 20 of the membrane circuit 2, the biasing member 4 will not disengage from the push button 7 or the base plate 3 regardless of the applied force on the upper side of the push button 7.

Since the membrane circuit 2 is disposed on the base plate 3, the need for a lower plate to sandwich the membrane circuit 2 with the base plate 3, as taught in the prior art, is thus obviated. As a result, the overall height of the computer key of this invention is reduced as compared to that of the prior art.

With this invention thus explained, it is apparent that numerous modifications and variations can be made without departing from the scope and spirit of this invention. It is therefore intended that this invention be limited only as indicated in the appended claims.

I claim:

1. A computer key, comprising:

a base plate including a first hingeably retaining member and a first slidably retaining guideway disposed to be spaced apart from each other in a longitudinal direction of said base plate so as to define an actuation area therebetween, said first hingeably retaining member and said first slidably retaining guideway being configured to have first and second retaining portions respectively extending uprightly from an upper surface of said base plate to block movement in an upward and normal direction relative to a plane of said upper surface;

a membrane circuit disposed on said upper surface of said base plate, said membrane circuit and having a contact area of a first dimension superimposed upon said actuation area, and first left and right openings disposed to match positions of said first and second retaining portions so as to permit said first and second retaining portions to extend outwardly through said first left and right openings;

a foil sheet member superimposed on said membrane circuit, said foil sheet member having a through hole of a second dimension corresponding to said contact area so as to expose said contact area, and second left and right openings aligned with said first left and right openings so as to permit said first and second retaining portions to extend outwardly through said second left and right openings;

an upright elastomeric biasing member including an upper depressing portion and a spacing lower portion to space said upper depressing portion from said contact area, said spacing lower portion having a flange portion extending outwardly from a lower end thereof with a third dimension such that said biasing member is seated above said contact area, thereby sandwiching said flange portion between said membrane circuit and said foil sheet member, wherein said upper depressing portion is movable against a biasing action thereof and via said through hole of said foil sheet member to depress said contact area of said membrane circuit to generate an electrical signal;

a push button disposed to actuate said depressing portion of said biasing member, said push button having a second hingeably retaining groove and a second slidably retaining guideway disposed in an underside thereof in diagonal positions relative to said first slidably retaining guideway and said first hingeably retaining member, respectively;

a first linking frame including:

a first transverse arm having a rear hooking end, a front hooking end and a first transverse axle interposed therebetween, said front hooking end being disposed to be initially inserted from a parallel direction relative to the plane of said upper surface, thereby simultaneously hingeably retaining said front and rear hooking ends in said first hingeably retaining member of said base plate so as to be blocked by said first retaining portion thereof from movement in said upward and normal direction; and a pair of first linking arms respectively and radially extending from two ends of said first transverse axle, and inboard to said front and rear hooking ends respectively, said first linking arms having a pair of first hooking fingers disposed at distal ends thereof parallel to said first transverse axle, said first hooking fingers being fitted to and being slidably retained in said second slidably retaining guideway of said push button; and a second linking frame including:

a second transverse axle fitted to and hingeably retained in said second hingeably retaining groove of said push button; and a pair of second linking arms respectively and radially extending from two ends of said second transverse axle and having a pair of second hooking fingers disposed at distal ends of said second linking arms and respectively parallel to said second transverse axle, said second hooking fingers being fitted to for slidably retention in said first slidably retaining guideway of said base plate;

said second linking arms and said first linking arms being pivotally connected to each other at intermediate portions thereof respectively such that said first and second linking arms confine a space for accommodating depressing movement of said biasing member when said front and rear hooking ends, said first hooking fingers, said second transverse axle, and said second hooking fingers are received in said first hingeably retaining member, said second slidably retaining guideway, said second hingeably retaining groove and said first slidably retaining guideway, respectively.

2. A computer key according to claim 1, wherein said base plate, said first hingeably retaining member and said first slidably retaining guideway are formed by punching a one-piece metal plate so as to configure said first and said second retaining portions on an opposite side of a direction of punching.

3. A computer key according to claim 2, wherein said first retaining portion includes a front retaining member and a rear retaining member disposed to be spaced apart from each other in a transverse direction of said base plate so as to retain said front and rear hooking ends respectively, wherein said front retaining member is of an arched shape and has a blocking segment extending in a parallel direction relative to said plane of said upper surface of said base plate so as to block said front hooking end from moving in said upward and normal direction.

4. A computer key according to claim 3, wherein said rear retaining member includes left and right jaw portions disposed uprightly and spaced from each other in said longitudinal direction of said base plate, said left and right jaw portion defining a clearance with a slightly smaller dimension than the dimension of the cross section of said rear hooking end for press-fitting of said rear hooking end when said rear hooking end is hingeably retained between said left and right jaw portions.

5. A computer key according to claim 4, wherein an upper end portion of said left jaw portion is bent in said longitudinal direction of said base plate away from said right jaw portion so that said right jaw portion is taller than said left jaw portion, thereby providing a guideway to facilitate press-fitting of said rear hooking end into said clearance.

6. A computer key according to claim 5, wherein said base plate defines a transverse slit adjacent to said left jaw portion, and at a side opposite to said clearance so as to provide resiliency to said left jaw portion in said longitudinal direction.

7. A computer key according to claim 1, further comprising an adhesive layer interposed between said flange portion and said foil sheet member to further strengthen immobility of said flange portion relative to said base plate.

* * * * *